United States Patent [19]

Frankenberg et al.

[11] 4,449,362

[45] May 22, 1984

[54] EXHAUST SYSTEM FOR AN INTERNAL COMBUSTION ENGINE, BURN-OFF UNIT AND METHODS THEREFOR

[75] Inventors: Alfred A. Frankenberg; Douglas R. Scott, both of Knoxville, Tenn.

[73] Assignee: Robertshaw Controls Company, Richmond, Va.

[21] Appl. No.: 326,527

[22] Filed: Dec. 2, 1981

[51] Int. Cl.[3] ..... F01N 3/02

[52] U.S. Cl. ..... 60/274; 55/282; 55/466; 55/DIG. 10; 55/DIG. 30; 60/286; 60/288; 60/297; 60/303; 60/311; 422/178; 422/183

[58] Field of Search ..... 60/274, 297, 311, 303, 60/286, 288; 55/282, 466, DIG. 10, DIG. 30, 314; 422/178, 183

[56] References Cited

U.S. PATENT DOCUMENTS

| | | | |
|---|---|---|---|
| 211,075 | 7/1980 | Ludecke et al. | 60/285 |
| 3,657,892 | 4/1972 | Perga | 60/297 |
| 3,779,015 | 12/1973 | Maruoka | 60/286 |
| 3,992,879 | 11/1976 | Miyamori | 60/288 |
| 4,217,757 | 8/1980 | Crone | 60/303 |
| 4,319,896 | 3/1982 | Sweeney | 60/311 |
| 4,359,862 | 11/1982 | Virk | 60/274 |
| 4,372,111 | 2/1983 | Virk | 60/274 |

FOREIGN PATENT DOCUMENTS

| | | | |
|---|---|---|---|
| 2756570 | 9/1978 | Fed. Rep. of Germany | 60/299 |
| 2845928 | 5/1979 | Fed. Rep. of Germany | 60/297 |
| 509 | 1/1981 | Japan | 60/297 |

OTHER PUBLICATIONS

"Particulate Filters: a 'Must' for Light-Duty Diesels?-"—at pp. 78–91 of the Mar. 1981, *Automotive Engineering* Magazine Suggestion by Another is Not Considered as Prior Art.

*Primary Examiner*—Douglas Hart

*Attorney, Agent, or Firm*—Candor, Candor & Tassone

[57] ABSTRACT

An exhaust system for an internal combustion engine which burns a hydrocarbon fuel mixture and which produces a carbonaceous particle carrying exhaust gas stream that passes through a filter of the system that retains at least part of the particles therein, the system having a burn-off unit for periodically burning the retained particles in the filter to tend to periodically clean the filter of the retained particles thereof. The burn-off unit is adapted to raise the temperature of the exhaust gas stream intermediate the engine and the filter to raise the temperature of the filter to particle burning temperature thereof, the burn-off unit injecting and burning a certain amount of the hydrocarbon fuel mixture in the exhaust gas stream intermediate the engine and the filter to raise the temperature of the exhaust gas stream intermediate the engine and the filter. The fuel mixture is injected into the exhaust gas stream by an aspirating unit of the burn-off unit, and the temperature of the exhaust gas stream is raised by an electrical heater and a catalyst bed in which the injected fuel mixture is to burn.

26 Claims, 3 Drawing Figures

EXHAUST SYSTEM FOR AN INTERNAL COMBUSTION ENGINE, BURN-OFF UNIT AND METHODS THEREFOR

BACKGROUND OF THE INVENTION

1. Field of the Invention

This invention relates to an improved exhaust system for an internal combustion engine and to a method of operating the same, this invention also relating to an improved burn-off means or unit for such a system or the like and to a method of making such a burn-off means or unit.

2. Prior Art Statement

It is known to provide an exhaust system for an internal combustion engine which burns a hydrocarbon fuel mixture and which produces a carbonaceous particle carrying exhaust gas stream that passes through a filter means of the system that retains at least part of the particles therein, the system having burn-off means for periodically burning the retained particles in the filter means to tend to periodically clean the filter means of the retained particles thereof. The burn-off means has means for raising the temperature of the exhaust gas stream intermediate the engine and the filter means to raise the temperature of the filter means to a particle burning temperature thereof.

One such prior known exhaust system is believed to utilize part of the hydrocarbon fuel mixture for the engine as a fuel to be injected and burned in the exhaust gas stream intermediate the engine and the filter means to raise the temperature of the filter means to particle burning temperature thereof. For example see FIG. 18 and pages 90 and 91 of the article "Particulate filters: a 'must' for light-duty diesels?" of pages 78–91 of the March 1981, Automotive Engineering magazine. The source of fuel for such burner is not disclosed in such article but is believed to be the same fuel that is utilized for the internal combustion engine that produces the exhaust gas stream being filtered and that the fuel is fed under pressure into the burner by an atomizing nozzle.

Another such prior known exhaust system utilizes an electrical heater means in the exhaust gas stream intermediate the engine and the filter means to raise the temperature of the filter means to a particle burning temperature thereof. For example, see the U.S. Pat. No. 4,211,075—Ludecke et al, wherein it appears that an electrical heater in the exhaust system thereof is disposed intermediate the engine and the filter means to raise the temperature of the exhaust gas stream being directed to the filter means to assist in the cleaning thereof, such exhaust system also controlling the amount of fuel air mixture being directed to the engine to control the temperature of the exhaust gas stream that leaves the engine and is directed toward the filter.

Another prior known means for controlling the amount of exhaust gas stream being directed to a filter to effect the cleaning thereof is set forth in the U.S. Pat. No. 4,217,757—Crone, wherein it appears that in the exhaust gas recycling system thereof, means are provided for controlling the amount of exhaust gas being passed over a filter means to control the temperature thereof.

During the development of the exhaust system of this invention wherein the applicants were aspirating the fuel mixture into the exhaust gas stream, another, who is not considered as a joint inventor of this invention with the applicants, suggested that a catalyst might be used to ignite the fuel injected into the exhaust gas stream but did not suggest any structure for so accomplishing such feature. Thereafter applicants through various attempts invented the unique arrangement illustrated in FIGS. 1 and 2 of this application wherein a catalyst bed is successfully utilized to ignite the fuel aspirated into the exhaust gas stream.

SUMMARY OF THE INVENTION

It is a feature of this invention to provide an improved exhaust system for an internal combustion engine wherein the filter means therefor can be periodically cleaned by periodically burning the retained carbonaceous particles collected therein.

In particular, a prior known exhaust system utilized a fuel feeding means to inject and burn fuel in the exhaust gas stream intermediate the engine and the filter means to raise the temperature of the exhaust gas stream intermediate the engine and the filter means and thereby raise the temperature of the filter means to particle burning temperature thereof, the fuel being injected into the exhaust stream intermediate the engine and the filter means comprising the same hydrocarbon fuel mixture which is utilized to operate the internal combustion engine that produces the exhaust gas stream to be filtered by the filter means.

However, this prior known arrangement is believed to utilize an atomizing nozzle for injecting the fuel under pressure into the exhaust gas stream whereas, in contrast, it was found according to the teachings of this invention that a unique and relatively simple aspirating means can be utilized to inject the fuel into the exhaust gas stream.

For example, one embodiment of this invention provides an exhaust system for an internal combustion engine which burns a hydrocarbon fuel mixture and which produces a carbonaceous particle carrying exhaust gas stream that passes through a filter means of the system that retains at least part of the particles therein, the system having burn-off means for periodically burning the retained particles in the filter means to tend to periodically clean the filter means of the retained particles thereof. The burn-off means comprises means for raising the temperature of the exhaust gas stream intermediate the engine and the filter means to raise the temperature of the filter means to a particle burning temperature thereof, the means for raising the temperature of the exhaust gas stream comprising means for injecting and burning a certain amount of the fuel mixture for the internal combustion engine in the exhaust gas stream intermediate the engine and the filter means. The means for injecting and burning comprises means for aspirating the certain amount of the fuel mixture into the exhaust gas stream intermediate the engine and the filter means and the means for raising the temperature of the exhaust gas stream comprises an electrical heater means and a catalyst bed in which the injected fuel mixture is to burn. The electrical heater means is disposed upstream from the catalyst bed and the means for aspirating the fuel mixture is disposed upstream of the catalyst bed. The heater means is disposed intermediate the means for aspirating the fuel mixture and the catalyst bed. The means for raising the temperature of the exhaust gas stream also comprises passage defining means having an inlet for receiving the exhaust gas stream from said engine and an outlet for directing the received exhaust gas stream to the filter means, the passage defining means having first and second passages respectively between the inlet and the outlet. The catalyst bed and the heater means is disposed in the second passage and the means for aspirating the fuel mixture is disposed to feed the fuel mixture to the second passage upstream of the heater means therein. The passage defining means has valve means for directing the exhaust gas stream to the filter means only through the first passage during the time the filter means is not being cleaned and for directing the exhaust gas stream to the filter means through the second passage during the time the filter means is to be cleaned. The valve means comprises a first valve disposed in a second passage between the means for aspirating the fuel mixture and the heater means for closing the second passage between the inlet and outlet thereof and a second valve disposed in the passage defining means for closing the first passage between the inlet and the outlet.

Accordingly, it is an object of this invention to provide an improved exhaust system for an internal combustion engine having one or of the novel features of this invention as set forth above or hereinafter shown or described.

Another object of this invention is to provide a method of operating such an exhaust system, the method of this invention having one or more of the novel features of this invention as set forth above or hereinafter shown or described.

Another object of this invention is to provide an improved burn-off means for an exhaust system for an internal combustion engine, the burn-off means of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
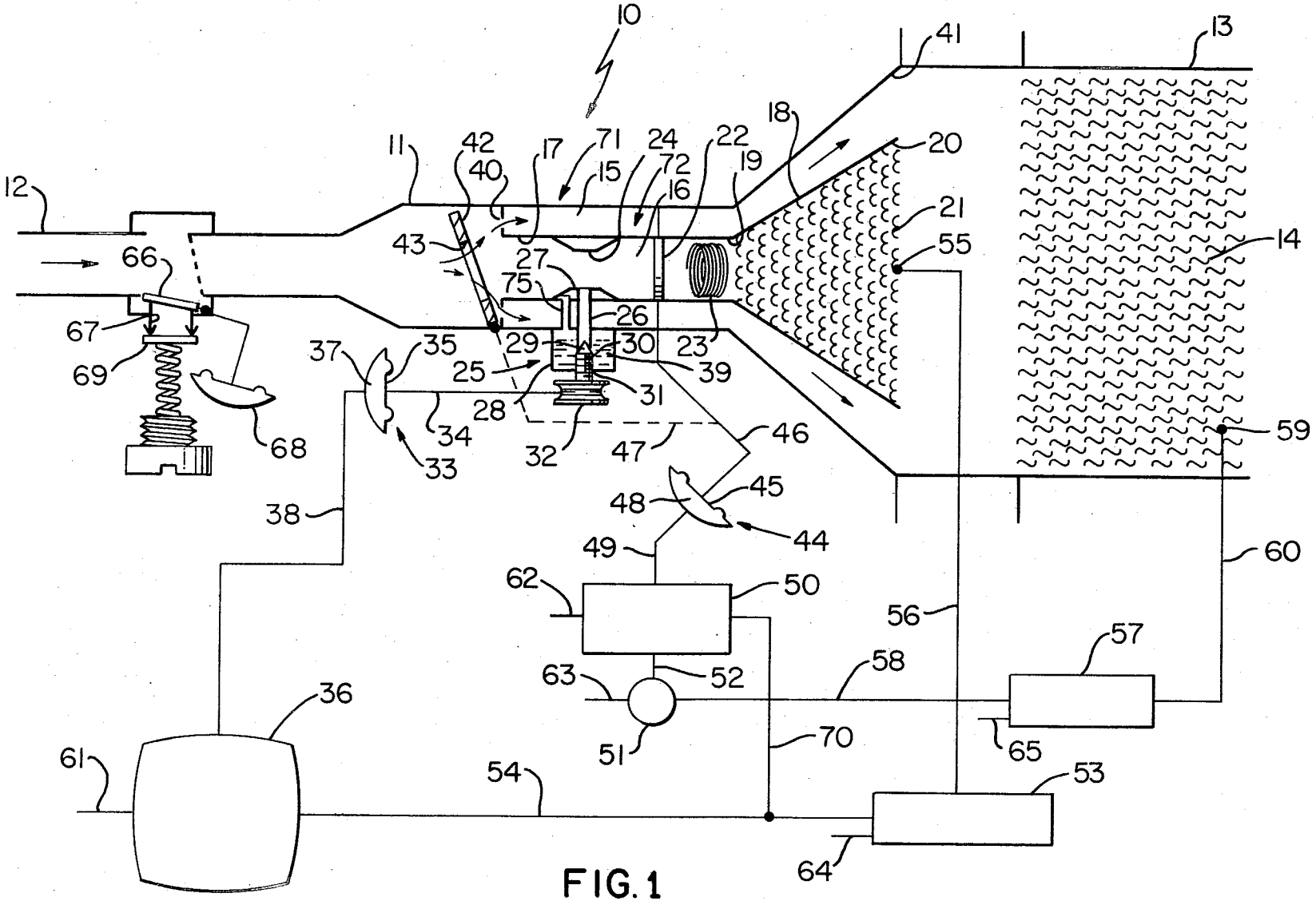
FIGS. 1 and 2 are schematic views illustrating the improved exhaust system of this invention, the exhaust system being disposed in its normal exhaust gas stream filtering condition in FIG. 1 and in its filter cleaning condition in FIG. 2.

While the various features of this invention are hereinafter described and illustrated as being particularly adapted to provide an exhaust system for a diesel engine of a transportation vehicle, it is to be understood that the various features of this invention can be utilized singly or in any combination thereof to provide an exhaust system for other types of engines as desired.

Therefore, this invention is not to be limited to only the embodiment illustrated in the drawings, because the drawings are merely utilized to illustrate one of the wide variety of uses of this invention.

Figure 2:
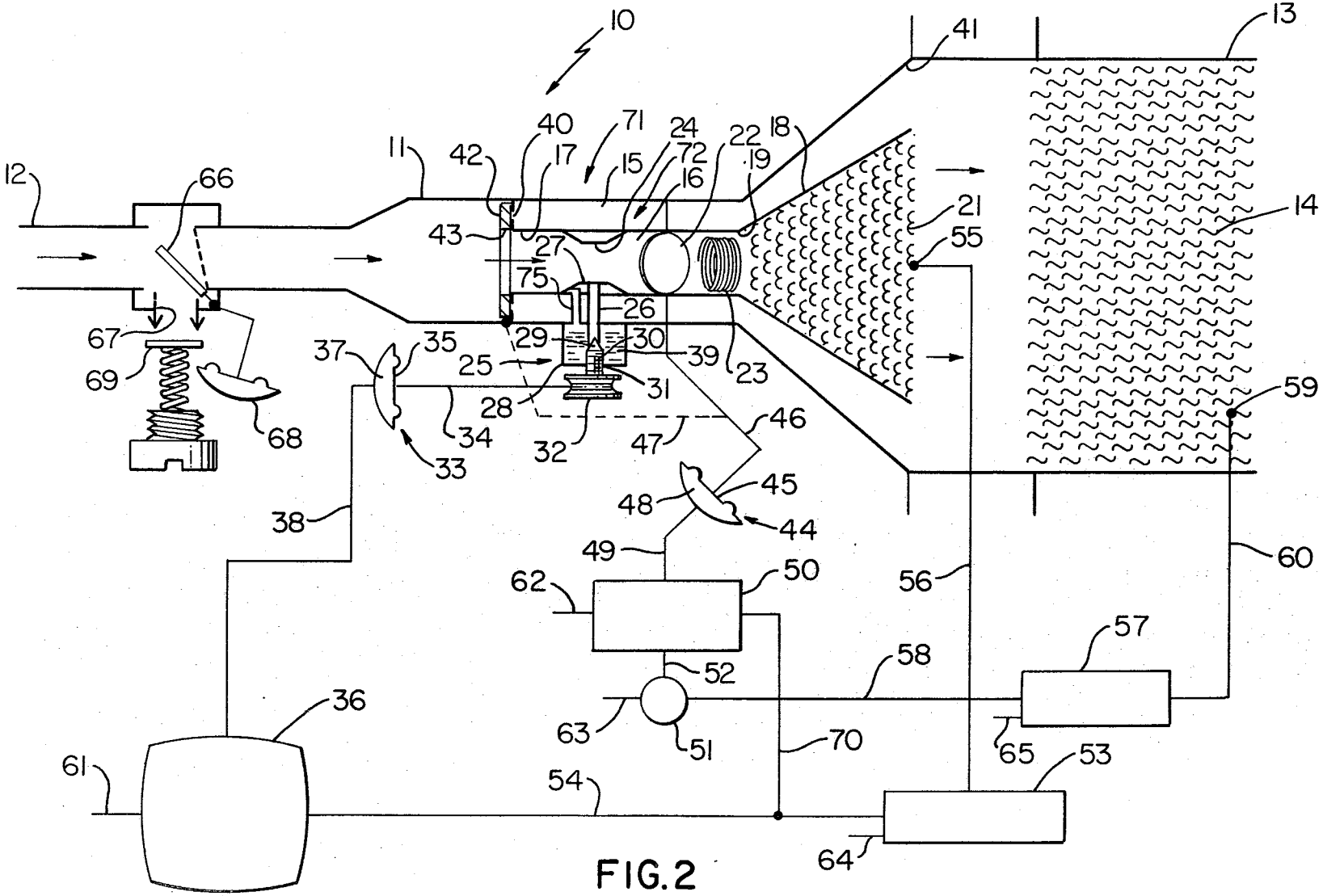

Referring now to FIGS. 1 and 2, the improved exhaust system of this invention for an internal combustion engine is generally indicated by the reference numeral 10 and comprises a passage defining means 11 having an inlet end 12 and an outlet end 13 whereby the inlet end 12 is adapted to be interconnected to the exhaust output of an internal combustion engine (not shown) that burns a hydrocarbon fuel mixture and thereby produces a carbonaceous particle carrying exhaust gas stream that enters the inlet 12 of the passage defining means 11 to exit out the outlet end 13 thereof to the atmosphere or other conduit means as the case may be.

The outlet end 13 of the passage defining means 11 contains a filter means 14 that substantially fills the outlet end 13 so that the entire flow of the exhaust gas stream that reaches the filter 14 must pass therethrough before exiting out of the outlet end 13 of the passage defining means 11.

While the filter means 14 can be any suitable structure which will tend to retain the carbonaceous particles being carried in the exhaust gas stream from the internal combustion engine so as to substantially clean the exhaust gas stream of its carbonaceous particles before the exhaust gas stream exits into the atmosphere, the filter means 14 can comprise ceramic beads, monolithic ceramic structures, metal wire mesh or multiple screen elements such as of stainless steel. However, any other suitable material and structures may be utilized. One filter means 14 that has been utilized according to the teachings of this invention comprises alumina coated stainless steel wire packed into the outlet end 13 of the passage defining means 11.

Thus, it can be seen that the filter means 14 can be made of any suitable material and configuration capable of trapping and holding substantial quantities of particulates from the engine exhaust gas stream without creating an excessive restriction to the exhaust gas flow and able to withstand the elevated temperatures to be reached in a subsequent incineration or burning of the trapped particles therein as will be apparent hereinafter.

The passage defining means 11 is provided with two passages 15 and 16 arranged substantially concentric to each other and intermediate the inlet 12 and the outlet 13 of the passage defining means 11, the passage 16 having an inlet means 17 that leads to a frusto-conical end section 18 that has a narrow inlet throat 19 and a wide outlet 20 and contains a suitable catalyst 21 for a purpose hereinafter described, the catalyst 21 comprising a noble metallic material such as a platinum coating on a stainless steel wire mesh. The catalyst 21 extends from the narrow inlet 19 to the large exit 20 of the frusto-conical section 18 whereby the frusto-conical section 18 comprises a catalyst bed for the exhaust system 10.

A butterfly valve 22 is disposed in the passage 16 intermediate the inlet 17 thereof and the throat 19 of the catalyst bed 18, the butterfly valve 22 being adapted to completely close off the passage 16 in the manner illustrated in FIG. 1 so as to prevent any of the exhaust gas stream that enters the inlet 17 of the passage 16 from reaching the catalyst bed 18.

An electrical heater 23 is also disposed in the passage 16 intermediate the valve 22 and the throat 19 of the catalyst bed 18, the electrical heater 23 being of any suitable configuration and wattage to function in the manner hereinafter set forth. However, in one embodiment of the exhaust system 10 of this invention, the heater 23 has comprised a 200 watt heater and was suitable for the exhaust system 10 of this invention when utilized with a conventional diesel engine of a passenger automobile.

The passage 16 is provided with a venturi means 24 intermediate the inlet 17 and the valve 22 whereby a fuel feeding or aspirating means 25 having an outlet passage 26 thereof communicating with the throat 27 of the venturi means 24 is adapted to have fuel drawn from a fuel reservoir 28 thereof and be aspirated into the passage means 16 at the venturi means 24 when the exhaust gas stream is permitted to flow through the passage means 16 as will be apparent hereinafter whereby it can be seen that the venturi means 24 forms part of the aspirating means 25 of this invention.

The fuel feeding or aspirating means 25 is adjustable and includes a metering pin 29 forming part of an externally threaded adjusting screw 30 threaded into a threaded opening 31 of the fuel reservoir 28 and being adapted to be adjusted relative to the outlet 26 by a pulley arrangement 32 controlled by a pneumatically operated actuator 33 interconnected to the pulley means 32 by a cable means 34 or the like.

A movable wall 35 of the actuator 33 is controlled by the value of a pneumatic signal directed thereto by a pneumatically operated controller 36 that directs the pneumatic signal to a chamber 37 of the actuator 33 through an interconnecting conduit means 38. Thus, depending upon the value of the pneumatic signal being received in the chamber 37 of the actuator 33, the actuator 33 rotates the pulley means 32 in a direction corresponding to such signal so as to position the metering pin 29 relative to the outlet passage 26 to control the amount of fuel being aspirated from the reservoir into the passage means 16 for a purpose hereinafter described.

The reservoir 28 contains a hydrocarbon fuel mixture 39 that is part of the same hydrocarbon fuel mixture which is burned in the internal combustion engine to operate the same so that the reservoir 28 is adapted to be supplied the fuel 39 from the same fuel tank that supplies the fuel to the internal combustion engine having the exhaust system 10 of this invention utilized therewith. In this manner, no separate source of fuel is required for the exhaust system 10 of this invention.

The passage 15 that is concentrically disposed about the passage 16 has an annular inlet 40 adjacent the inlet 17 of the passage 15 and has an annular outlet 41 adjacent the outlet 20 of the passage 16.

A movable annular valve member 42 is adapted to be closed against the inlet 40 of the passage 15 in the manner illustrated in FIG. 2 to completely close off the passage 15 from the exhaust gas stream entering the passage defining means 11 at the inlet 12 thereof, the valve member 42 having an opening 43 passing therethrough for permitting fluid flow into the inlet 17 of the passage 16 when the valve member 42 is in the closed condition against the inlet 40 of the passage 15 as illustrated in FIG. 2 for a purpose hereinafter described.

When the valve member 42 is disposed in the open condition illustrated in FIG. 1, not only is the exhaust gas stream from the inlet 12 of the passage defining means 11 adapted to enter the inlet 40 of the passage 16, but also such exhaust gas stream is adapted to enter the inlet 17 of the passage 15 whereby it can be seen that if the butterfly valve 22 is disposed in its closed condition illustrated in FIG. 1 when the valve member 42 is disposed in the open condition illustrated in FIG. 1, the entire flow of the exhaust gas stream permitted to pass through the passage defining means 11 passes only through the passage 15. Conversely, when the valve member 42 is disposed in the closed position illustrated in FIG. 2 and the valve member 22 is disposed in the open condition illustrated in FIG. 2, the entire exhaust gas stream permitted to flow through the passage defining means 11 only flows through the passage 16 and not through the passage 15 for a purpose hereinafter set forth.

The valves 22 and 42 are interconnected together to be operated in the above manner by a pneumatically operated actuator 44 having its movable wall or flexible diaphragm 45 interconnected to the valve member 22 by an interconnection means 46 that is also interconnected to the valve 42 by an interconnection means 47 whereby the value of a pneumatic signal being directed to a chamber 48 of the actuator 44 by a conduit means 49 leading from a pneumatically operated controller 50 determines the position of the valves 22 and 42 as will be apparent hereinafter.

The controller 50 is a pneumatically operated timer means that is initially actuated by a pneumatically operated controller 51 interconnected thereto by a conduit means 52 and itself being initially actuated either manually or automatically as desired. Once the pneumatically operated timer 50 has been actuated it will operate the actuator 44 in a timed sequence of operation thereof in a manner hereinafter set forth.

A pneumatically operated transducer 53 has its pneumatic output signal interconnected to the controller 36 by a conduit means 54 and has the value of its pneumatic signal being directed into the conduit means 54 in relation to the temperature being sensed at the catalyst bed 18 by a temperature sensor 55 interconnected to the transducer by interconnection means 56.

In this manner, the transducer 53 is adapted to direct a pneumatic signal to the controller 36 in relation to the temperature of the catalyst bed 18 as sensed by the temperature sensor 55 so that the controller 36 can control the actuator 33 and, thus, the fuel feeding means 25 in relation to the temperature of the catalyst bed 18 as will be apparent hereinafter in order to maintain the temperature of the catalyst bed 18 at the desired temperature during the filter cleaning or burning operation as hereinafter described.

Another pneumatically operated transducer 57 is adapted to produce an output signal in a conduit means 58 that leads to the controller 51 in relation to the temperature of the filter means 14 as sensed by a temperature sensor 59 interconnected to the transducer 57 by an interconnection means 60.

In this manner, should the filter means 14 not reach the desired burn-off temperature thereof as will be apparent hereinafter, after the cleaning cycle of the system 10 has been initiated by the controller 51, the transducer 57 can direct the controller 51 to repeat the cleaning cycle so as to produce the desired burn-off temperature in the filter means 14. Also, the transducer 57 can send a signal when the filter 14 has reached the desired burn-off temperature in order to terminate the cleaning cycle, if desired.

While the temperature sensors 55 and 59 have been illustrated as being located respectively at the outlet ends of the catalyst bed 18 and the filter means 14, it is to be understood that the temperature sensors 55 and 59 can be located in any desired position in the catalyst 21 and the filter means 14 depending upon the structure thereof and the desired place for a reading of the temperature thereof.

In order to operate the pneumatically operated controllers 36, 50 and 51 and the pneumatically operated transducers 53 and 57, a suitable pneumatic source can be provided therefor and can comprise a positive pressure source or a vacuum source as provided by a pressure pump or vacuum pump driven by the internal combustion engine of the system.

In any event, the pneumatic source for the controller 36, 50 and 51 and transducers 53 and 57 are respectively represented by the conduit means 61, 62, 63, 64 and 65 in the drawings.

If desired, a diverter valve 66 can be disposed in the inlet means 12 of the passage defining means 11 so as to divert part of the exhaust gas stream that enters the inlet means 12 out through an exit means 67 during the burning or regeneration cycle of the exhaust system 10 as the use of the entire exhaust gas stream flow is not necessary at such time. However, during the normal filtering operation of the system 10, the diverter valve 66 is disposed in the closed condition illustrated in FIG. 1 so as to prevent any bypassing of the exhaust gas stream out through the exit means 67.

When the system 10 is being utilized to clean or burn the trapped particles in its filter means 14 in a manner hereinafter set forth, the diverter valve 66 can be disposed in an intermediate position thereof such as illustrated in FIG. 2 by a pneumatically operated actuator 68 so that part of the flow of the exhaust gas stream will pass into the exit means 67 and act against a pressure relief valve means 69 to open the exit means 67 in the manner illustrated in FIG. 2 so that only part of the exhaust gas stream will be directed to the passage 16 of the passage defining means 11 during the cleaning cycle of the system 10 of this invention and be of a predetermined pressure value as determined by the setting of the pressure relief valve 69.

The fuel aspirating means 25 includes a passage means 75 that fluidly interconnects the passage 16 at a point upstream of the throat 27 of the venturi means 24 to the reservoir 28 so as to provide a pressure differential across the outlet means 26 at the throat 27 of the venturi means 24 so that fuel can be aspirated from the reservoir 28 into the throat 27 of the venturi means 24 when the exhaust gas stream is permitted to flow through the passage 16 as will be apparent hereinafter.

Figure 3:
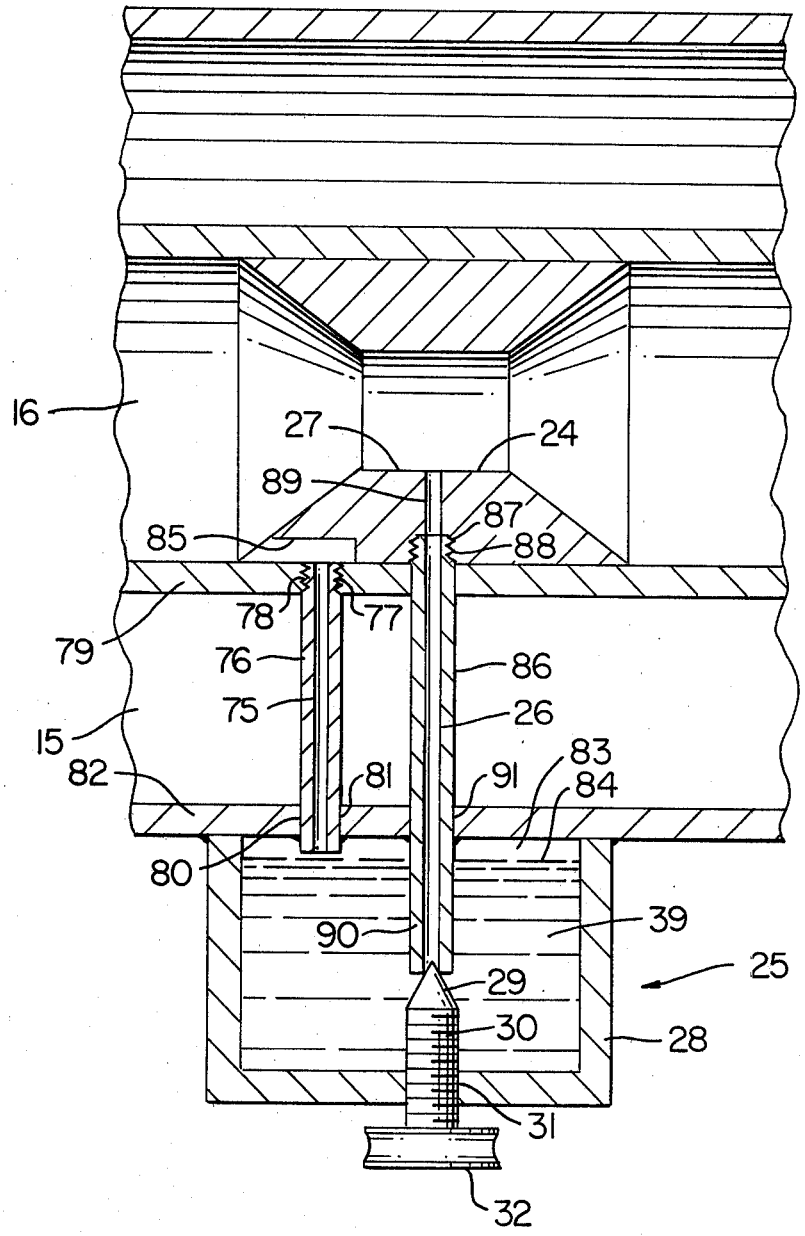
FIG. 3 is an enlarged fragmentary view of part of the system of FIGS. 1 and 2.

In particular, reference is now made to FIG. 3 wherein the passage means 75 comprises a conduit means 76 having a threaded end 77 disposed in a threaded bore 78 in a conduit member 79 that defines the passage 16, the conduit 76 having a lower end 80 passing through an opening 81 in an outer conduit member 82 that defines the passage 15 so that the lower end 80 of the conduit 76 is disposed in fluid communication with the chamber 83 in the reservoir 28 at a point above the surface 84 of the fuel mixture 39 contained within the chamber 83 of the reservoir 28.

The venturi means 24 has a passage 85 that is disposed substantially parallel with the longitudinal axis of the passage 16 and interconnects with the upper end 77 of the conduit 75 so that the passage 85 interconnects the passage 16 to the chamber 83 of the reservoir 28 at a point upstream of the throat 27 of the venturi means 24.

The outlet passage means 26 of the fuel aspiration means 25 comprises a conduit means 86 having an upper threaded end 87 disposed in a threaded portion 88 of an opening 89 passing transversely through the venturi means 24 to the throat 27 thereof, the lower end 90 of the conduit means 86 passing through an opening 91 in the conduit member 82 so as to be disposed in the reservoir 28 well below the surface 84 of the fuel mixture 39 therein and cooperate with the needle valve 30 in the manner previously set forth.

In this manner, when the exhaust gas stream is permitted to flow through the passage means 16 from left to right in FIG. 3 and, thus, through the throat 27 of the venturi means 24, the pressure created on the surface 84 of the fuel mixture 39 in the reservoir 28 comprises the total of the velocity and static pressures of the exhaust gas stream picked up by the passage 85 of the venturi means 24 and directed by the conduit means 76 to the chamber 83 above the surface 84 of the fuel mixture 39 so that a pressure differential is created across the outlet means 26 at the throat 27 of the venturi means 24 to cause the fuel mixture 39 in the reservoir 28 to flow up the conduit 86 and out of the port 89 of the venturi means 24 under the control of the control valve 29 because it is well known that the pressure valve at the throat of a venturi is less than the pressure valve of the fluid upstream of the throat that is flowing through the venturi means.

Therefore, it can be seen that the exhaust system 10 of this invention can be made from a relatively few parts by the method of this invention to effectively operate in a manner now to be described.

During the normal driving conditions for a diesel fuel operated transportation vehicle or the like, the exhaust system 10 of this invention is disposed in the condition illustrated in FIG. 1 wherein the diverter valve 66 completely closes the exit means 67 and the butterfly valve 22 completely closes the passage 16 so that the entire exhaust gas stream from the internal combustion engine enters the inlet 12 of the passage defining means 11 and passes through the outer passage 15 to the filter means 14 to have at least a part of the carbonaceous particles and the like in the exhaust gas stream retained in the filter means 14 so that a relatively clean exhaust gas stream exits out of the outlet means 13 of passage defining means 11. Thus, it can be seen that there is no exhaust gas flow through the passage 16 during the normal filtering operation so that no fuel 39 from the reservoir 28 is aspirated from the fuel feeding means 25 during the normal exhaust gas filtering operation of the exhaust system 10.

When a sufficient amount of particulates have been collected in the filter means 14 so that it is desirable to regenerate the filter means 14 by burning the trapped particles therefrom, either manually or automatically the controller 51 is actuated so that the same not only actuates the timer controller 50 but also actuates the actuator 68 to move the diverter valve 66 from the closed condition illustrated in FIG. 1 to the diverting position illustrated in FIG. 2 to permit a portion of the exhaust gas stream to flow through the pressure relief valve 69 so that the amount of the exhaust gas stream permitted to flow through the passage defining means 11 is controlled by the pressure relief valve 69 which regulates the pressure of the exhaust gas stream upstream of the diverter valve 66 as the engine speed changes whereby a substantially constant pressure exhaust gas stream is provided during the cleaning cycle. However, it may be possible to eliminate the diverting of a portion of exhaust gas stream flow with a passage 16 and a catalyst bed 18 formed large enough to accommodate the full exhaust stream flow although there may be a fuel consumption penalty for such an arrangement.

When the pneumatically operated timer means 50 is initially actuated by the controller 51, the controller 50 causes the electrical heater means 23 to be energized and after a short period, long enough for the heater 23 to get hot, the butterfly valve 22 is opened by the actuator 44 on a timed basis, initially slowly enough to permit the heater 23 to transfer its heat to a small mass of exhaust gas and fuel mixture that is now permitted to pass through the partially opened butterfly valve 22 so that the same will cause an exothermic reaction to start in the catalyst bed 18 adjacent the narrow throat 19 thereof. It has been found that a diesel fuel and air mixture will ignite at approximately 500° F. in the presence of the catalyst 21.

This diesel fuel-air mixture now being presented to the catalyst bed 18 is caused by the exhaust gas stream flowing through the venturi means 24 and causing an aspiration of the fuel 39 from the reservoir 28 into such gas stream in the manner previously described to provide the diesel fuel and air mixture sufficient to ignite at the inlet end 19 of the catalyst bed 18.

Thus, the opening of the butterfly valve 22 starts at a slow rate to get the process started in the catalyst bed 18 and the rate of opening of the butterfly valve 22 increases with time to keep the ignition portion of the cleaning cycle as short as possible.

Since the annular diverting valve 42 is linked to the butterfly actuator 44, the valve 42 closes as the butterfly valve 22 opens and fully closes the annular inlet 40 of the passage 15 when the butterfly valve 22 is fully opened as illustrated in FIG. 2 thereby forcing all of the exhaust gas stream downstream from the diverting valve 66 to pass through the passage 16 and, thus, through the catalyst bed 18 which is now completely burning from its inlet 19 to its outlet 20 and raising the temperature of the exhaust gas stream now passing therethrough through the filter means 14.

As previously set forth, the temperature of the catalyst bed 18 is sensed by the temperature sensor 55 which through the transducer 53 and controller 36 controls the fuel-air ratio at the aspirating venturi means 24 to control the catalyst bed temperature by varying the amount of fuel being permitted to mix with the exhaust gas stream that reaches the catalyst bed 18.

It has been found that the particulates in the filter means 14 will burn if raised to approximately 1000° F. and that maintaining the catalyst bed 18 at approximately 1200° F. will provide adequate heat energy in the heated exhaust gas stream through the filter means 14 to transfer enough heat to the filter means 14 to cause the carbon particulates retained therein to begin burning at the upstream side of the filter means 14 whereby an exothermic reaction then proceeds through the filter means 14 to the outlet side thereof.

Thus, by substantially accurately controlling the temperature of the catalyst bed 18 by controlling the fuel-air mixture through the adjustable fuel feeding means 25, the temperature of the filter means 14 can be substantially accurately controlled to not only cause the burning of the carbonaceous particles thereof, but also to prevent an over temperature thereof that would have an adverse effect on the filter material.

When the regeneration or burning cycle for the filter means 14 is completed, such as by a time interval or by being sensed by the temperature sensor 59 so as to cause the transducer 57 to signal the controller 51 to terminate the operation, the controller 51 causes all of the control components to return to their normal driving positions as illustrated in FIG. 1 so that the entire exhaust gas stream from the engine will again pass through only the passage 15 of the passage defining means 11 to filter means 14 to be filtered thereby in the manner previously set forth.

Thus, it can be seen that as long as the controller 51 is operated in a periodic manner, the filter means 14 of the system 10 will be periodically cleaned in the above manner.

If during a regeneration cycle of the exhaust system 10 as previously set forth wherein the pneumatically operated timer means 50 has been initially actuated to proceed through the timed cleaning cycle thereof the catalyst bed 18 should fail to ignite during the initial small opening of the butterfly valve 22, such lack of a high temperature in the catalyst bed 18 being sensed by the temperature sensor 55 will cause the transducer 53 to provide a signal in the output conduit 54 thereof that can be directed to the controller 50 by a branch conduit means 70 so as to cause the timer means 50 to cease operation thereof and return to either its off condition or to reinitiate the beginning cycle thereof to again attempt to ignite the catalyst bed 18 in the manner previously described.

From the above description of the operation of the exhaust system 10 of this invention, it can be seen that the portion of the passage defining means 11 upstream from the filter means 14 comprises a sub-assembly that is a "burn-off means" 71 of the system 10 when in its cleaning cycle and the passage 16 and its components therein define a "torch" 72 for such burn-off means 71 to heat the carbonaceous particles in the filter means 14 to their ignition temperature.

Therefore, it can be seen that this invention provides an improved exhaust system for an internal combustion engine which is adapted to utilize the same fuel mixture that the internal combustion engine utilizes to regenerate a filter means of the exhaust system, this invention also providing an improved method of operating such an exhaust system. In addition, this invention provides an improved burn-off means for such an exhaust system and a method of making the same.

While the forms and methods of this invention now preferred have been illustrated and described as required by the Patent Statute, it is to be understood that other forms and method steps can be utilized and still fall within the scope of the appended claims.

What is claimed is:

1. In an exhaust system for an internal combustion engine which burns a hydrocarbon fuel mixture and which produces a carbonaceous particle carrying exhaust gas stream that passes through a filter means of said system that retains at least part of said particles therein, said system having burn-off means for periodically burning said retained particles in said filter means to tend to periodically clean said filter means of said retained particles thereof, said burn-off means comprising means for raising the temperature of said exhaust gas stream intermediate said engine and said filter means to raise the temperature of said filter means to particle burning temperature thereof, said means for raising the temperature of said exhaust gas stream comprising means for injecting and burning a certain amount of said fuel mixture in said exhaust gas stream intermediate said engine and said filter means, the improvement wherein said means for injecting and burning comprises means for aspirating said certain amount of said fuel mixture into said exhaust gas stream intermediate said engine and said filter means and said means for raising the temperature of said exhaust gas stream comprises an electrical heater means and a catalyst bed in which said injected fuel mixture is to burn, said electrical heater means being disposed upstream from said catalyst bed, said means for aspirating said fuel mixture being disposed upstream of said catalyst bed, said heater means being disposed intermediate said means for aspirating said fuel mixture and said catalyst bed, said means for raising the temperature of said exhaust gas stream also comprising passage defining means having an inlet for receiving said exhaust gas stream from said engine and an outlet for directing said received exhaust gas stream to said filter means, said passage defining means having first and second passages respectively between said inlet and said outlet, said catalyst bed and said heater means being disposed in said second passage, said means for aspirating said fuel mixture being disposed to feed said fuel mixture to said second passage upstream of said heater means therein, said passage defining means having valve means for directing said exhaust gas stream to said filter means only through said first passage during the time said filter means is not being cleaned and for directing said exhaust gas stream to said filter means through said second passage during the time said filter means is to be cleaned, said valve means comprising a first valve disposed in said second passage between said means for aspirating said fuel mixture and said heater means for closing said second passage between said inlet and said outlet and a second valve disposed in said passage defining means for closing said first passage between said inlet and said outlet.

2. An exhaust system as set forth in claim 1 wherein said catalyst bed has a catalyst therein, said catalyst comprising a noble metal means.

3. An exhaust system as set forth in claim 1 and including interconnecting means operatively interconnecting said first and second valves together so that said second valve is fully closed when said first valve is fully opened.

4. An exhaust system as set forth in claim 1 wherein said valve means includes a diverter valve disposed in said inlet for diverting a portion of said exhaust gas stream away from said passage defining means during the time said filter means is to be cleaned.

5. An exhaust system as set forth in claim 1 wherein said second passage has a venturi means therein, said means for aspirating said fuel mixture having an outlet means in fluid communication with said venturi means whereby said venturi means and said outlet means comprise said means for aspirating said fuel mixture.

6. An exhaust system as set forth in claim 5 wherein said means for aspirating said fuel mixture comprises a reservoir for containing said fuel mixture, said outlet means being in fluid communication with said reservoir, and means fluidly interconnecting said second passage upstream of said venturi means therein to said reservoir to provide a pressure differential across said outlet means at said venturi means.

7. An exhaust system as set forth in claim 5 wherein said means for aspirating said fuel mixture is adjustable, and control means being operatively interconnected to said means for aspirating said fuel mixture to adjust the same in relation to the temperature of said catalyst bed.

8. An exhaust system as set forth in claim 7 wherein said means for aspirating said fuel mixture has an adjustable valve means operatively associated with said outlet, said control means controlling said valve means to adjust the same in relation to the temperature of said catalyst bed.

9. An exhaust system as set forth in claim 8 wherein said control means has means for sensing the temperature of said catalyst bed.

10. In a burn-off means for an exhaust system of an internal combustion engine which burns a hydrocarbon fuel mixture and which produces a carbonaceous particle carrying exhaust gas stream that passes through a filter means of said system that retains at least part of said particles therein, said burn-off means being adapted for periodically burning said retained particles in said filter means to tend to periodically clean said filter means of said retained particles thereof, said burn-off means comprising means for raising the temperature of said exhaust gas stream intermediate said engine and said filter means to raise the temperature of said filter means to particle burning temperature thereof, said means for raising the temperature of said exhaust gas stream comprising means for injecting and burning a certain amount of said fuel mixture in said exhaust gas stream intermediate said engine and said filter means, the improvement wherein said means for injecting and burning comprises means for aspirating said certain amount of said fuel mixture into said exhaust gas stream intermediate said engine and said filter means and said means raising the temperature of said exhaust gas stream comprises an electrical heater means and a catalyst bed in which said injected fuel mixture is to burn, said electrical heater means being disposed upstream from said catalyst bed, said means for aspirating said fuel mixture being disposed upstream of said catalyst bed, said heater means being disposed intermediate said means for aspirating said fuel mixture and said catalyst bed, said means for raising the temperature of said exhaust gas stream also comprising passage defining means having an inlet for receiving said exhaust gas stream from said engine and an outlet for directing said received exhaust gas stream to said filter means, said passage defining means having first and second passages respectively between said inlet and said outlet, said catalyst bed and said heater means being disposed in said second passage, said means for aspirating said fuel mixture being disposed to feed said fuel mixture to said second passage upstream of said heater means therein, said passage defining means having valve means for directing said exhaust gas stream to said filter means only through said first passage during the time said filter means is not being cleaned and for directing said exhaust gas stream to said filter means through said second passage during the time said filter means is to be cleaned, said valve means comprising a first valve disposed in said second passage between said means for aspirating said fuel mixture and said heater means for closing said second passage between said inlet and said outlet and a second valve disposed in said passage defining means for closing said first passage between said inlet and said outlet.

11. A burn-off means for an exhaust system as set forth in claim 10 wherein said catalyst bed has a catalyst therein, said catalyst comprising a noble metal means.

12. A burn-off means for an exhaust system as set forth in claim 10 and including interconnecting means operatively interconnecting said first and second valves together so that said second valve is fully closed when said first valve is fully opened.

13. A burn-off means for an exhaust system as set forth in claim 10 wherein said valve means includes a diverter valve disposed in said inlet for diverting a portion of said exhaust gas stream away from said passage defining means during the time said filter means is to be cleaned.

14. A burn-off means for an exhaust system as set forth in claim 10 wherein said second passage has a venturi means therein, said means for aspirating said fuel mixture having an outlet means in fluid communication with said venturi means whereby said venturi means and said outlet means comprise said means for aspirating said fuel mixture.

15. A burn-off means for an exhaust system as set forth in claim 14 wherein said means for aspirating said fuel mixture comprises a reservoir for containing said fuel mixture, said outlet means being in fluid communication with said reservoir, and means fluidly interconnecting said second passage upstream of said venturi means therein to said reservoir to provide a pressure differential across said outlet means at said venturi means.

16. A burn-off means for an exhaust system as set forth in claim 15 wherein said means for aspirating said fuel mixture is adjustable, and control means being operatively interconnected to said means for aspirating said fuel mixture to adjust the same in relation to the temperature of said catalyst bed.

17. A burn-off means for an exhaust system as set forth in claim 16 wherein said means for aspirating said fuel mixture has an adjustable valve means operatively associated with said outlet, said control means controlling said valve means to adjust the same in relation to the temperature of said catalyst bed.

18. A burn-off means for an exhaust system as set forth in claim 17 wherein said control means has means for sensing the temperature of said catalyst bed.

19. In a method of operating an exhaust system for an internal combustion engine which burns a hydrocarbon fuel mixture and which produces a carbonaceous particle carrying exhaust gas stream that passes through a filter means of said system that retains at least part of said particles therein, said method comprising the steps of periodically burning said retained particles in said filter means with burn-off means to tend to periodically clean said filter means of said retained particles thereof, said step of burning comprising the step of raising the temperature of said exhaust gas stream intermediate said engine and said filter means to raise the temperature of said filter means to particle burning temperature thereof, said step of raising the temperature of said exhaust gas stream comprising the step of injecting and burning a certain amount of said fuel mixture in said exhaust gas stream intermediate said engine and said filter means, the improvement wherein said step for injecting and burning comprises the step of aspirating said certain amount of said fuel mixture into said exhaust gas stream intermediate said engine and said filter means with an aspirating means and said step of raising the temperature of said exhaust gas stream comprising the steps of operating an electrical heater means and burning said injected fuel mixture in a catalyst bed, said step of raising the temperature of said exhaust gas stream also comprises the step of operating said electrical heater means upstream from said catalyst bed, said step of aspirating said fuel mixture comprising the step of aspirating said fuel mixture into said exhaust stream upstream of said catalyst bed, said heater means being disposed intermediate said aspirating means and said catalyst bed, said step of raising the temperature of said exhaust gas stream also comprising the steps of directing said exhaust gas stream from said engine into an inlet of a passage defining means, directing said received exhaust gas stream out of an outlet of said passage defining means to said filter means, said passage defining means having first and second passages respectively between said inlet and said outlet, said catalyst bed and said heater means being disposed in said second passage, said aspirating means being disposed to aspirate said fuel mixture into said second passage upstream of said heater means therein, and operating valve means of said passage defining means to direct said exhaust gas stream to said filter means only through said first passage during the time said filter means is not being cleaned and to direct said exhaust gas stream to said filter means through said second passage during the time said filter means is to be cleaned, said valve means comprising a first valve disposed in said second passage between said aspirating means and said heater means for closing said second passage between said inlet and said outlet and a second valve disposed in said passage defining means for closing said first passage between said inlet and said outlet.

20. A method of operating an exhaust system as set forth in claim 19 and including the steps of disposing a catalyst in said catalyst bed, and forming said catalyst from a noble metal means.

21. A method of operating an exhaust system as set forth in claim 19 and including the step of operating said first and second valves together so that said second valve is fully closed when said first valve is fully opened.

22. A method of operating an exhaust system as set forth in claim 19 and including the step of diverting a portion of said exhaust gas stream away from said inlet of said passage defining means during the time said filter means is to be cleaned.

23. A method of operating an exhaust system as set forth in claim 19 wherein said step of aspirating said fuel mixture into said second passage includes the step of aspirating with a venturi means.

24. A method of operating an exhaust system as set forth in claim 23 and including the step of adjusting said aspirating means in relation to the temperature of said catalyst bed.

25. A method of operating an exhaust system as set forth in claim 24 wherein said step of adjusting said aspirating means includes the step of adjusting valve means of said venturi means.

26. A method of operating an exhaust system as set forth in claim 24 and including the step of sensing the temperature of said catalyst bed.

* * * * *